US007000294B2

(12) United States Patent
Kakuda et al.

(10) Patent No.: US 7,000,294 B2
(45) Date of Patent: Feb. 21, 2006

(54) FASTENER DRIVING TOOLS

(75) Inventors: Nobuyuki Kakuda, Anjo (JP); Yasuyuki Fujimoto, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 10/774,184

(22) Filed: Feb. 6, 2004

(65) Prior Publication Data

US 2004/0222266 A1 Nov. 11, 2004

(30) Foreign Application Priority Data

Feb. 7, 2003 (JP) ..... 2003-031006
Dec. 1, 2003 (JP) ..... 2003-401885

(51) Int. Cl.
*B25C 5/02* (2006.01)

(52) U.S. Cl. ..... 27/120; 227/123

(58) Field of Classification Search ..... 227/120, 227/119, 121, 123
See application file for complete search history.

(56) References Cited

U.S. PATENT DOCUMENTS 3,615,049 A * 10/1971 Obergfell et al. ..... 227/28
4,573,624 A * 3/1986 Muller et al. ..... 227/121
5,180,091 A 1/1993 Ota
5,368,213 A * 11/1994 Massari, Jr. ..... 227/123
5,593,079 A * 1/1997 Mukoyama et al. ..... 227/8
5,662,257 A * 9/1997 Mukoyama et al. ..... 227/8
5,816,468 A * 10/1998 Yang ..... 227/8
5,927,585 A * 7/1999 Moorman et al. ..... 227/132
6,199,739 B1 * 3/2001 Mukoyama et al. ..... 227/8
2003/0111239 A1 * 6/2003 Smolinski

* cited by examiner

*Primary Examiner*—Scott A. Smith
*Assistant Examiner*—Brian Nash
(74) *Attorney, Agent, or Firm*—Lahive & Cockfield, LLP; Anthony A. Laurentano, Esq.

(57) ABSTRACT

A fastener driving tool includes a tool body. A driver guide is coupled to the tool body and defines a fastener driving channel though which fasteners are driven out. A magazine is coupled to the driver guide and serves to store the fasteners. A detecting device serves to detect when no fastener exists within the fastener driving channel. The detecting device includes a detection member and a detection recess formed in a fastener driving channel. The detection member has a front end in contact with the fasteners stored within magazine, so that the detecting member engages the detection recess when no fastener exists within the magazine and the fastener driving channel. The detection recess is positioned not to oppose the head of the fastener that has been fed into the fastener driving channel.

12 Claims, 12 Drawing Sheets

FASTENER DRIVING TOOLS

This application claims priorities to Japanese patent application serial numbers 2003-31006 and 2003-401885, the contents of which are incorporated herein by reference.

BACKGROUND OF THE INVENTION

1. Field of the Invention

The present invention relates to fastener driving tools, such as nailers and tackers.

2. Description of the Related Art

In general, fastener driving tools have magazines for storing a plurality of fasteners, e.g., nails, tacks, staples, etc., drivers for driving the fasteners, and devices (known as "idle driving prevention devices") for preventing the operation of the drivers when all of the fasteners within the magazines have been used.

Japanese Patent No. 2,640,988 teaches a known idle driving prevention device. In this patent, a fastener driving tool is configured as a "finishing nailer". A magazine stores a flat, plate-like nail strip comprising a plurality of small headed nails that are arranged in parallel and joined in series with each other. A pusher plate is disposed within the magazine for pushing the stored nails toward a nail driving channel, so that the nails are fed one after another into the nail driving channel in response to the driving operation.

The idle driving prevention device of this patent includes a stopper member and a stopper projection. The stopper member is coupled to a trigger that is mounted to a tool body of the nailer. The stopper member has an end portion that extends into the magazine. The stopper projection is formed on the pusher plate and is positioned within the magazine. When the last nail remaining within the magazine has been driven out (in other words, when all the stored nails have been exhausted), the stopper projection of the pusher plate moves to a predetermined position where the stopper member engages the stopper projection. Consequently, the stopper member cannot be moved and the trigger cannot be operated to actuate the driver. As a result, the idle driving prevention device can inhibit the nail driver operation.

In addition, the above patent teaches a technique to allow the pusher plate to move by a distance that is greater than a thickness of an individual nail, after the last nail has been fed within the nail driving channel and driven out of the tool (to enable detection of a possible idle driving operation). The two states, before and after the last nail is driven, can be clearly distinguished from each other based on the increased shifting movement of the pusher plate. Therefore, possible malfunctions of the idle driving prevention device can be minimized and the reliability of the idle driving prevention device can be improved.

In order to ensure a large shifting distance of the pusher plate for detecting possible idle driving operations, there has been a proposed solution to form a detection recess in the nail driving channel in a position opposing the pusher plate. Because the front end of the pusher plate can enter the detection recess, the pusher plate can be shifted by a distance corresponding to the depth of the detection recess in addition to the distance corresponding to the thickness of an individual nail. Therefore a large shifting distance of the pusher plate can be ensured after the last nail has been driven out.

However, in the known idle driving prevention device, the detection recess of the nail driving channel is positioned on the lateral side of the heads of the nails. Therefore, if thin nails, e.g. nails having a thickness of 0.6 mm or nails known as "pin nails", that are more slender than finishing nails and are easily bendable, are adapted to be driven and stored in the magazine, the last nail that has been fed into the nail driving channel may not be properly held against the inner wall of the nail driving channel because the detection recess is positioned on the lateral side of the head of the last nail. Rather, it is likely that the last nail is bent at a portion adjacent to its head. Consequently, a nail driver may not appropriately contact the head of the last nail, and as a result, the last nail may not be properly driven.

SUMMARY OF THE INVENTION

It is accordingly an object of the present invention to teach improved fastener driving tools that enables the fasteners to be reliably driven while the presence of no fastener within a fastener driving channel can be detected.

According to one aspect of the present teachings, fastener driving tools are taught that include a tool body. A driver guide is coupled to the tool body and defines a fastener driving channel though which fasteners, in this embodiment for example, nails and tacks, are driven out, so that the fasteners may be driven into a workpiece. For example, the nails may be in the form of a strip that includes parallel nails joined to each other. A magazine is coupled to the driver guide and serves to store the fasteners. A detecting device serves to detect when no more fastener exists within the fastener driving channel. The detecting device includes a detection member and a detection recess formed in a fastener driving channel. The detection member has a front end contacting the last one of the fasteners stored within the magazine. The detecting member moves in the fastener feeding direction as the fasteners within the magazine are driven out from the fastener driving channel one after another. The front end of the detection member engages the detection recess when no more fasteners exist within the magazine and the fastener driving channel. The detection recess is positioned so as to not oppose the head of the fastener that has been fed into the fastener driving channel. The detection recess can take a variety of forms. For example, the detection recess may be a bottomed recess or may extend throughout the thickness of the driver guide.

Therefore, the fastener can be reliably held against the inner wall of the fastener driving channel. In addition, the fastener may be prevented from being bent at the head even if the fastener has a relatively thin thickness. As a result, the fastener can be reliably driven through the fastener driving channel without fail.

In another aspect of the present teachings, the detection member is movable by a distance greater than the thickness of an individual fastener when the last fastener has been driven out from the fastener driving channel.

Because the detection member is movable by a distance greater than the thickness of one fastener when the last fastener has been driven out from the fastener driving channel, the position of the detection member before the last fastener is driven out and the position of the detection member after the last fastener has been driven out can be clearly distinguished from one another. Therefore, this change of position of the detection member can be used as a reliable indication of the non-presence of the fasteners. An idle driving operation can be reliably inhibited based on this indication as to when no fasteners remain within the fastener driving channel.

In another aspect of the present teachings, the magazine is configured to store many different types and sizes of available fasteners that can vary with respect to length. The ends of the fasteners opposite to heads of the fasteners are positioned at the same reference level in the magazine irrespective of the difference in types. The detection recess is disposed at a position spaced in the fastener driving direction separated from the head of the fastener that has the shortest available length and yet is still capable of being fed into the fastener driving channel.

With this arrangement, the detection recess never directly opposes the heads of any type of available fasteners, regardless of different lengths. Therefore, these various types of available fasteners can be reliably driven without fail.

In addition to or alternatively to this arrangement, the detection recess may be disposed at a position spaced along a direction, opposite to the fastener driving direction, away from the head of the fastener having the longest available length, the position measured from when the end of the fastener contacts a workpiece during the driving operation of the fastener through the fastener driving channel. With this arrangement, the detection recess never opposes the head of any type of available fasteners having different lengths when and after the lower end of the fastener contacts the workpiece. Therefore, the head of the fastener can be reliably held against the inner wall of the fastener driving channel when and after the lower end of the fastener contacts the workpiece. When the lower end of the fastener contacts the workpiece, a large force is applied to the fastener in order to drive the fastener into the workpiece. However, the head of the fastener may be prevented from being bent by this driving force because the head can be reliably held against the inner wall of the fastener driving channel.

In another aspect of the present teachings, the fastener driving tool includes a trigger operable by an operator in order to drive the fastener fed into the fastener driving channel. An engaging member is coupled to the trigger so that the engaging member moves together with the trigger as the trigger is operated. The detection member is engageable with the engaging member to prevent the trigger from being operated when the front end of the detection member enters the detection recess. In this way, the detection member may also serve as a restriction member for restricting the movement of the engaging member, and the engaging member may serve as a stopper member that cooperates with the detection member in order to prevent or stop the operation of the trigger.

When the front end of the detection member enters into the detection recess, i.e., when no fastener exists within the fastener driving channel, the detection member engages the engaging member so that the trigger may be prevented from being operated. Therefore, the idle driving operation can be inhibited.

In another aspect of the present teachings, the fastener driving tools further include a driver that is movable within the fastener driving channel in order to apply an impact on the head of a fastener, fed into the fastener driving tool, when the trigger is operated.

In another aspect of the present teachings, the engaging member has an inclined surface inclined with respect to the moving direction of the engaging member. The inclined surface is formed in continuity with the engaging recess, so that the detection member is shifted in the direction opposite to the fastener feeding direction through a sliding contact between the inclined surface and the engaging edge as the engaging member moves in response to the operation of the trigger in order to drive out the last fastener fed into the fastener driving channel.

Therefore, even if the front end of the detection member enters the fastener driving channel when the last fastener has been fed into the channel, for example, possibly caused due to a small thickness (e.g., 6 mm) of the fastener, the inclined front end of the detection member may move away from the fastener driving channel as the engaging member slides along the incline of the detection member when the trigger is operated. Therefore, the driver may not apply a full direct impact force to the front end of the detection member. Instead, the driver may apply the majority of the impact force primarily upon the head of the fastener. As a result, no significant damage occurs to the front end of the detection member by the driver. This allows the detection member to continue to accurately and reliably detect the non-presence fasteners within the fastener driving channel.

In another aspect of the present teachings, a pusher plate is biased in the fastener feeding direction towards the fastener driving channel and has a front end that contacts the last fastener (with regard to driving sequence) within the magazine. The fasteners are forced towards the fastener driving channel by the pusher plate. The pusher plate is a separate component member from the detection member. Therefore, the detection function of the detection member can be performed independently of the fastener feeding function of the pusher plate.

In another aspect of the present teachings, fastener driving tools are taught that include a tool body and a driver guide. The driver guide is coupled to the tool body and defines a fastener driving channel. A magazine is coupled to the driver guide and serves to store fasteners. A detecting device serves to detect when no more fasteners remain within the fastener driving channel. The detecting device includes a detection member. The detecting member is biased in a fastener feeding direction and contacts the last fastener within the magazine. A driver is movable within the fastener driving channel in order to apply an impact upon the head of a fastener fed into the fastener driving channel when the trigger is operated. An impact prevention device serves to prevent the undesired application of an impact upon the detecting member by the driver when the last fastener is driven out of the fastener driving channel.

With this type of arrangement, the driver may not apply an impact to the detection member but may apply an impact only upon the head of the fastener. As a result, the driver causes no significant damage to the detection member and the detection member can accurately and reliably detect the non-presence of a fastener within the fastener driving channel.

In another aspect of the present teachings, the impact prevention device comprises a cam mechanism provided between the detection member and an engaging member coupled to a trigger. The detection member is moved away from the fastener driving channel as the engaging member moves together with the trigger when the trigger is operated to drive the last fastener.

In another aspect of the present teachings, the engaging member moves substantially perpendicular to the fastener feeding direction. A cam mechanism includes an inclined surface formed on the engaging member and is inclined with respect to the moving direction of the engaging member.

DETAILED DESCRIPTION OF THE INVENTION

Each of the additional features and teachings disclosed above and below may be utilized separately or in conjunction with other features and teachings to provide improved fastener driving tools and methods of using such improved fastener driving tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
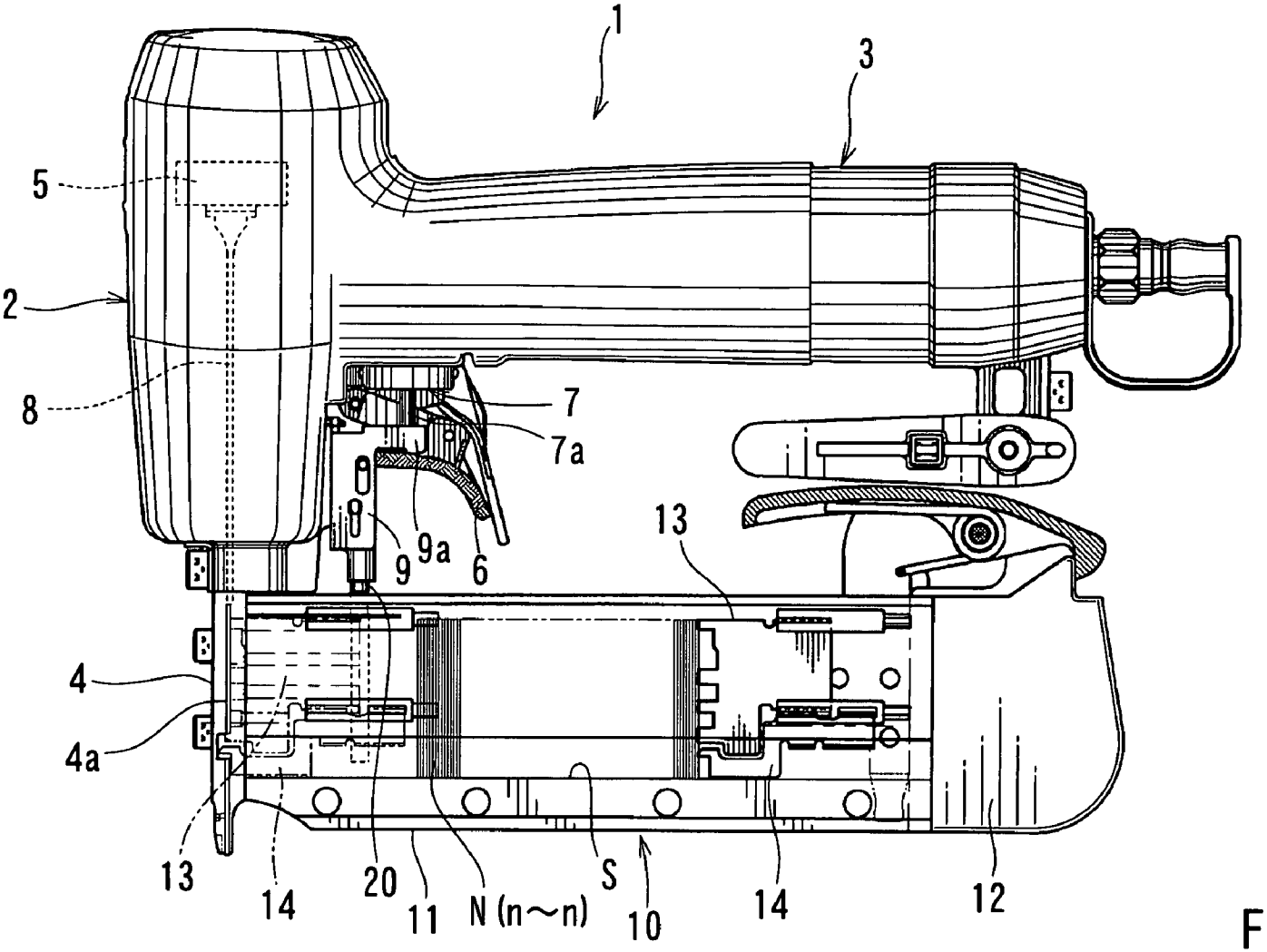
FIG. 1 is a side view of a first representative nailer.

A first representative embodiment will now be described with reference to FIGS. 1 to 8. Referring to FIG. 1, there is generally shown a first representative nailer 1 as an example of a fastener driving tool. The representative nailer 1 includes a main body 2, a handle 3, a driver guide 4 and a magazine 10. A drive piston 5 is disposed within the main body 2. The handle 3 extends laterally (rightward as viewed in FIG. 1) from a lateral side of main body 2. The driver guide 4 extends vertically downward from the lower end of the main body 2. The magazine 10 extends between the driver guide 4 and the right end of the handle 3.

A driver 8 extends downward from the drive piston 5 along the central axis of the drive piston 5 and has a lower portion that is inserted into a nail driving channel 4*a* formed within the driver guide 4.

A trigger 6 is mounted to the lower side of the left end portion of the handle 3 in a position adjacent to the main body 2. The trigger 6 is operable to drive the drive piston 5 as will be explained later. A trigger valve 7 is mounted within the handle 3 and has a stem 7*a* that is positioned above the trigger 6. An air hose (not shown) may be connected to the right end of the handle 3, so that compressed air may be supplied into the handle 3 via the air hose may be accumulated within the handle 3. When the trigger 6 is pulled upward, the stem 7*a* is depressed to open the trigger valve 7 causing compressed air to be supplied into an upper chamber of a cylinder (not shown) on the upper side of the drive piston 5. Then, the drive piston 6 is forced to move downward due to the pressure of the compressed air within the upper chamber, so that the driver 8 moves downward into the nail driving channel 4*a*. During the downward movement, the driver 8 contacts one of the nails n fed into the nail driving channel 4*a* so that the one nail n is driven out from the lower end of the driver guide 4.

A restriction block 9 is vertically movably mounted to the lateral side of the main body 2 in a position adjacent to the trigger 6. A restriction arm 9*a* extends laterally from the upper end of the restriction block 9 and has a front end that contacts the upper surface of the trigger 6, so that the restriction block 9 moves upward as the trigger 6 is pulled. If the restriction block 9 is prevented from being moved upward, the trigger 6 may not be pulled. In such a case, the drive piston 5 may not be moved to drive the nails n.

A stopper 20 is attached to the restriction block 9 and extends downward from the lower end of the restriction block 9 into the backside of the magazine 10 (as viewed in FIG. 1). The stopper 20 serves as an idle driving prevention device as will be hereinafter explained.

The magazine 10 has a magazine body 11 and a cover 12 that is slidably mounted to the magazine body 11. Cover 12 can open and close in order to provide access to an open side of the magazine body 11. In this representative embodiment, the nails n are arranged parallel to each other and joined so as to be configured as a flat, plate-like strip N.

The magazine body 11 has a reference edge S that defines the position of the lower ends (opposite to the head) of the nails n when the nails n are set into the magazine body 11. In this representative embodiment, the magazine 10 is designed to store a variety of different kinds (e.g., five kinds) of nails with a variety of different overall lengths. All of the various types of nails may be set into the magazine with the lower ends of the nails positioned substantially at the level of the reference edge S. In other words, the magazine body 11 positions of the heads of the nails may vary in the vertical direction (i.e., the driving direction of the nails) in response to the varying length of the nails.

A pusher plate 13 is disposed within the magazine body 11 and serves to urge the strip N (i.e., made up of individual nails n) in a nail feeding direction (a leftward direction as viewed in FIGS. 1 to 4, 7, and 8). A biasing device, e.g., for example a coil spring (not shown), biases the pusher plate 13 in the nail feeding direction. Therefore, as soon as the driver 8 returns to its uppermost position after the driver 8 has driven an individual nail n that was previously fed into the nail driving channel 4*a*, the strip N is moved toward the nail feeding direction by the pusher plate 13. As a result, the next individual nail n is automatically supplied into the nail driving channel 4*a*.

Figure 2:
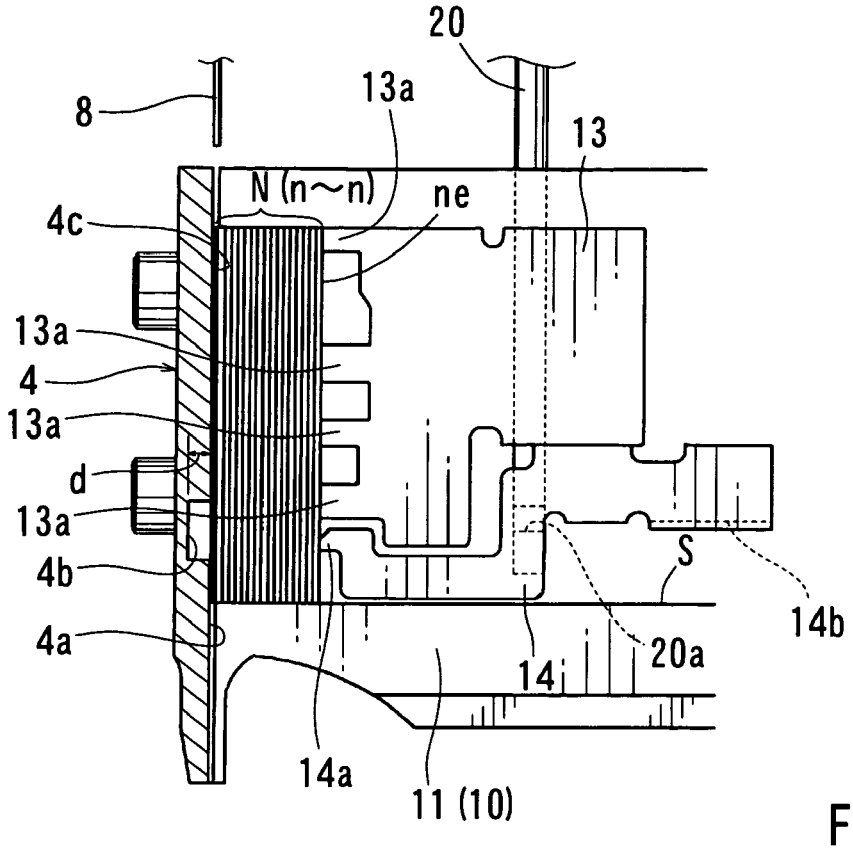
FIG. 2 is an enlarged side view detailing the connecting region between a driver guide and a magazine of the first representative nailer, and showing a state where the longest available length of nails set with some nails remaining within the magazine and with the nail located within the nail driving channel filled in black for purposes of illustration.
Figure 3:
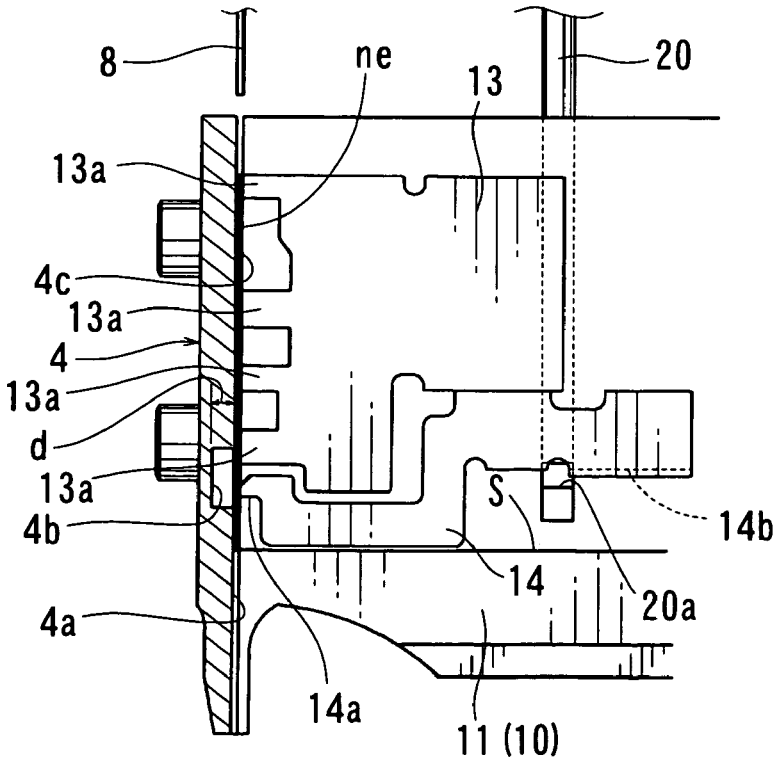
FIG. 3 is a view similar to FIG. 2 but showing a state where the last nail has been fed into the nail driving channel.
Figure 4:
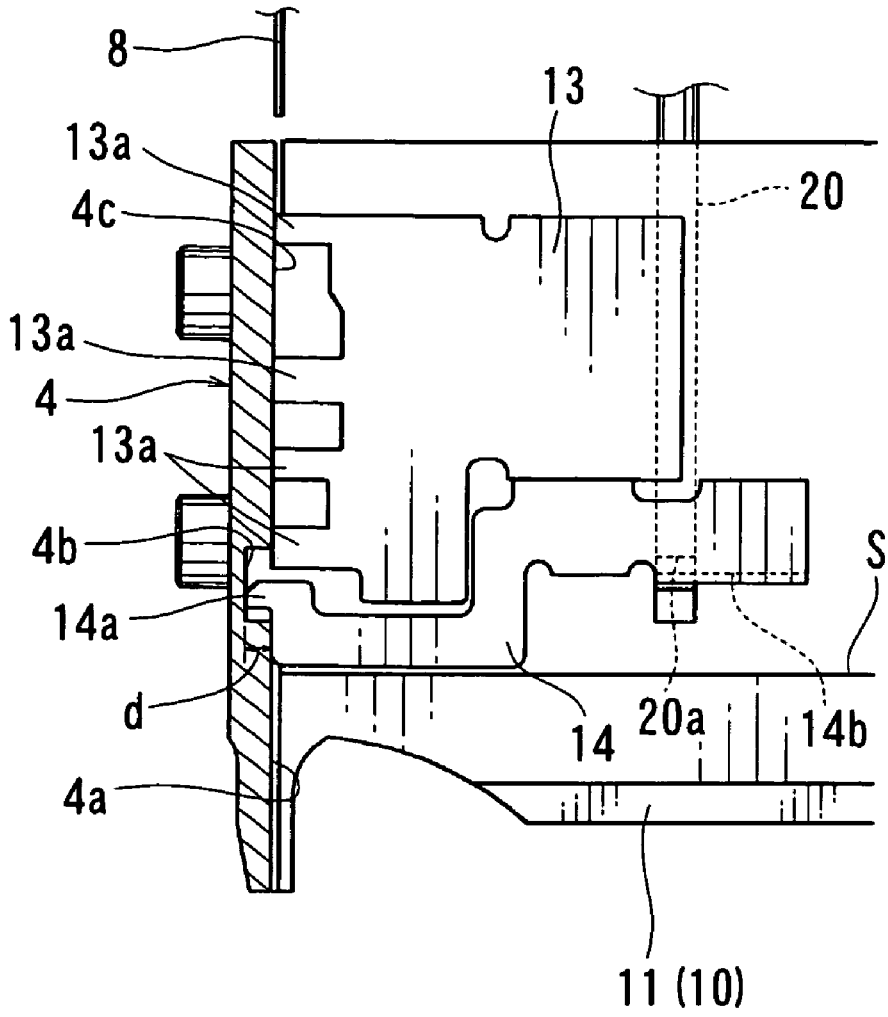
FIG. 4 is a view similar to FIG. 3 but showing the state where the last nail has been driven out from the nail driving channel.
Figure 7:
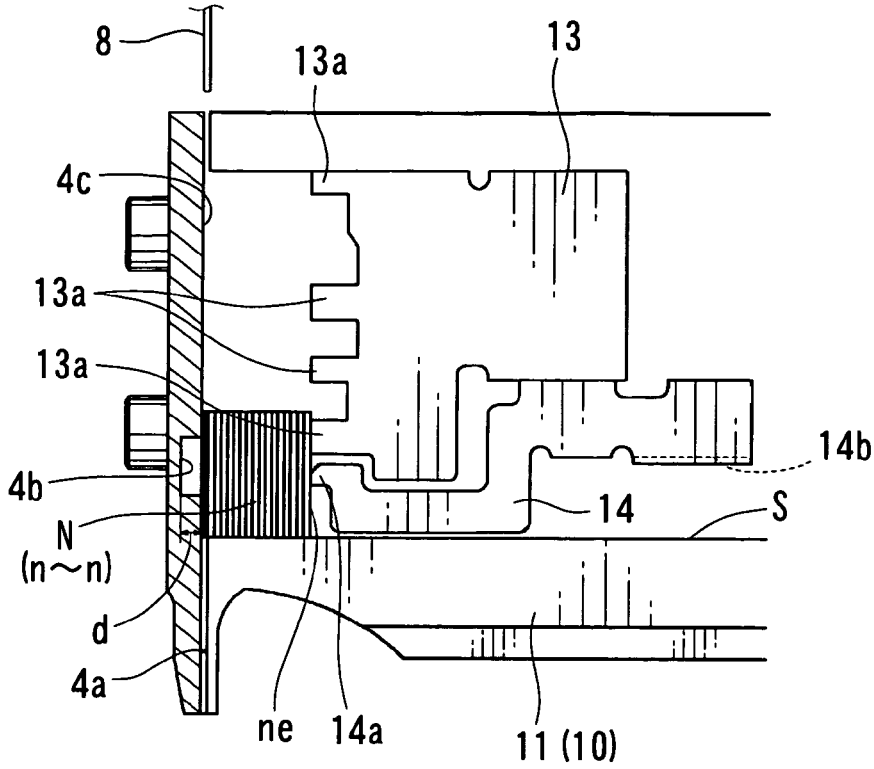
FIG. 7 is a view similar to FIG. 2 but showing a state where nails of the shortest available length are set with some nails remaining within the magazine, and the nail within the nail driving channel filled in black for purposes of illustration.
Figure 8:
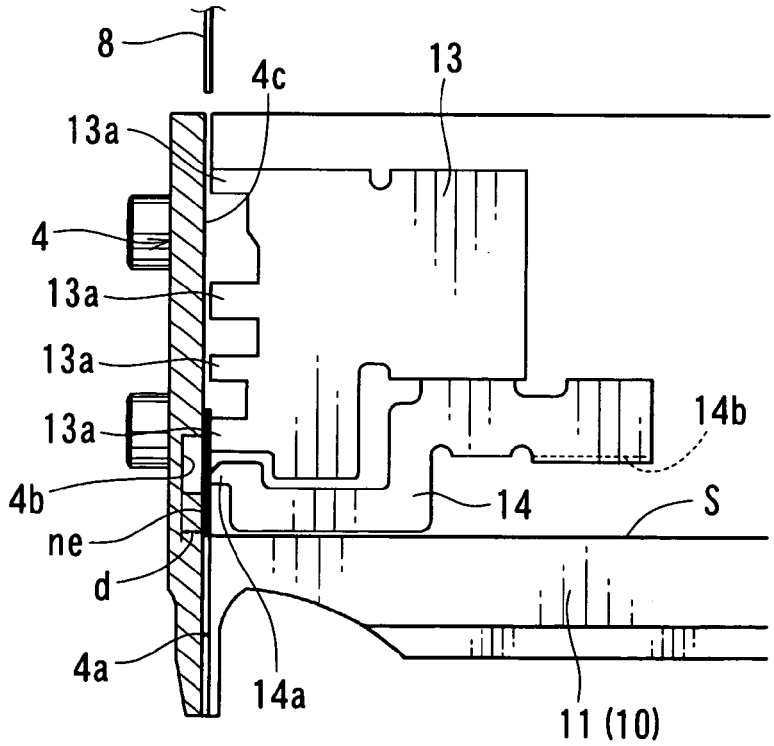
FIG. 8 is a view similar to FIG. 7 but showing a state where the last nail has been supplied into the nail driving channel.

As shown in FIGS. 2 to 4, four contact portions 13*a* in this particular embodiment are formed on the front end (the left end as viewed in FIGS. 2 to 4) of the pusher plate 13. The contact portions 13*a* are spaced from each other by a suitable distance in the vertical direction, i.e., the nail driving direction, corresponding to the various sizes of nails. Therefore, the pusher plate 13 presses the strip N of the nails n via the contact portions 13*a* contacting the last nail ne in the strip N. FIGS. 2 and 3 show an exemplary situation where the pusher plate 13 pushes against a strip N made up of a type of nails n having the longest length accommodated by the magazine 11. In this particular case, all of the contact portions 13*a* contact the last nail ne. FIGS. 7 and 8 show an exemplary situation where the pusher plate 13 presses another type of strip N, this time made up of nails n having the shortest length accommodated by the magazine 11. Only the lower most of the contact portions 13*a* is in contact with the last nail ne.

A separate restriction plate 14 is disposed apart from the pusher plate 13 and is movable in the nail feeding direction independently of the pusher plate 13. The restriction plate 14 is biased in the nail feeding direction by a biasing device, e.g., a spring, that may be a separate device independent from the biasing device of the pusher plate 13.

The restriction plate 14 has a front end contact portion 14*a* (left end as viewed in FIGS. 2 to 4) that also contacts the last nail ne among the nails n stored in the magazine 10, so that the strip N of the nails n is pressed toward the nail feeding direction by both of the pusher plate 13 and the restriction plate 14.

When the last nail ne has been fed into the nail driving channel 4*a* as shown in FIG. 3, the last nail ne may be held against an inner wall 4*c* of the nail driving channel 4*a* by the pusher plate 13 and also by the restriction plate 14 that contacts the lower portion of the last nail ne via the front end contact portion 14*a*.

After the last nail ne has been driven out from the nail driving channel 4*a* by the driver 8, no nail exists within the nail driving channel 4*a* as shown in FIG. 4. In this state, both of the pusher plate 13 and the restriction plate 14 have moved towards the inner wall 4*c* of the nail driving channel 4*a* by means of their respective biasing devices.

A detection recess 4*b* is formed in the inner wall 4*c* of the nail driving channel 4*a* in a position opposing the front end contact portion 14*a* of the restriction plate 14. As shown in FIGS. 2 and 3, the detection recess 4*b* is positioned to oppose the lateral side of the lower portions of the nails n but does not directly oppose the lateral side of the head of the nails n. More specifically, the position and the length in the vertical direction of the detection recess 4*b* is determined in such a way so that the detection recess 4*b* may oppose the lateral side of the lower portions of various kinds of the nails n while not opposing the heads of these various kinds of nails n. Therefore, the last nail ne, regardless of length, may be properly held against the inner wall 4*c* of the nail driving channel 4*a* with a low chance of the nail being bent at its head.

As soon as the last nail ne has been driven out from the nail driving channel 4*a*, the restriction plate 14 moves toward the nail feeding direction. The front end contact portion 14*a* of the restriction plate 14 enters the detection recess 4*b*. Therefore, the shifting distance of the restriction plate 14, after the last nail ne has been driven out, becomes greater than the shifting distance of the pusher plate 13 by a distance corresponding to a depth d of the detection recess 4*b*.

In other words, after the last nail ne has been driven out, the pusher plate 13 moves by a distance corresponding to the thickness of the last nail ne and then contacts the inner wall 4*c* of the nail driving channel 4*a*. The movement of the pusher plate 13 is then stopped. However, after the last nail ne has been driven out, the restriction plate 14 moves by a distance corresponding to the depth of the detection recess 4*b* in addition to the distance corresponding to the thickness of the last nail ne. In this embodiment, the movement of the restriction plate 14 is stopped when the front end contact portion 14*a* of the restriction plate 14 contacts the left most inner surface of the detection recess 4*b* (as shown in FIG. 4).

Because the restriction plate 14 moves by a distance that is greater than the thickness of the nail n after the last nail ne has been driven out, it is possible to clearly distinguish between the state where no nail n exists within the nail driving channel 4*a*, and the state where a nail n remains within the nail driving channel 4*a*. Therefore, the idle driving prevention device can reliably operate by utilizing the relatively large shifting movement of the restriction plate 14.

Figure 5:
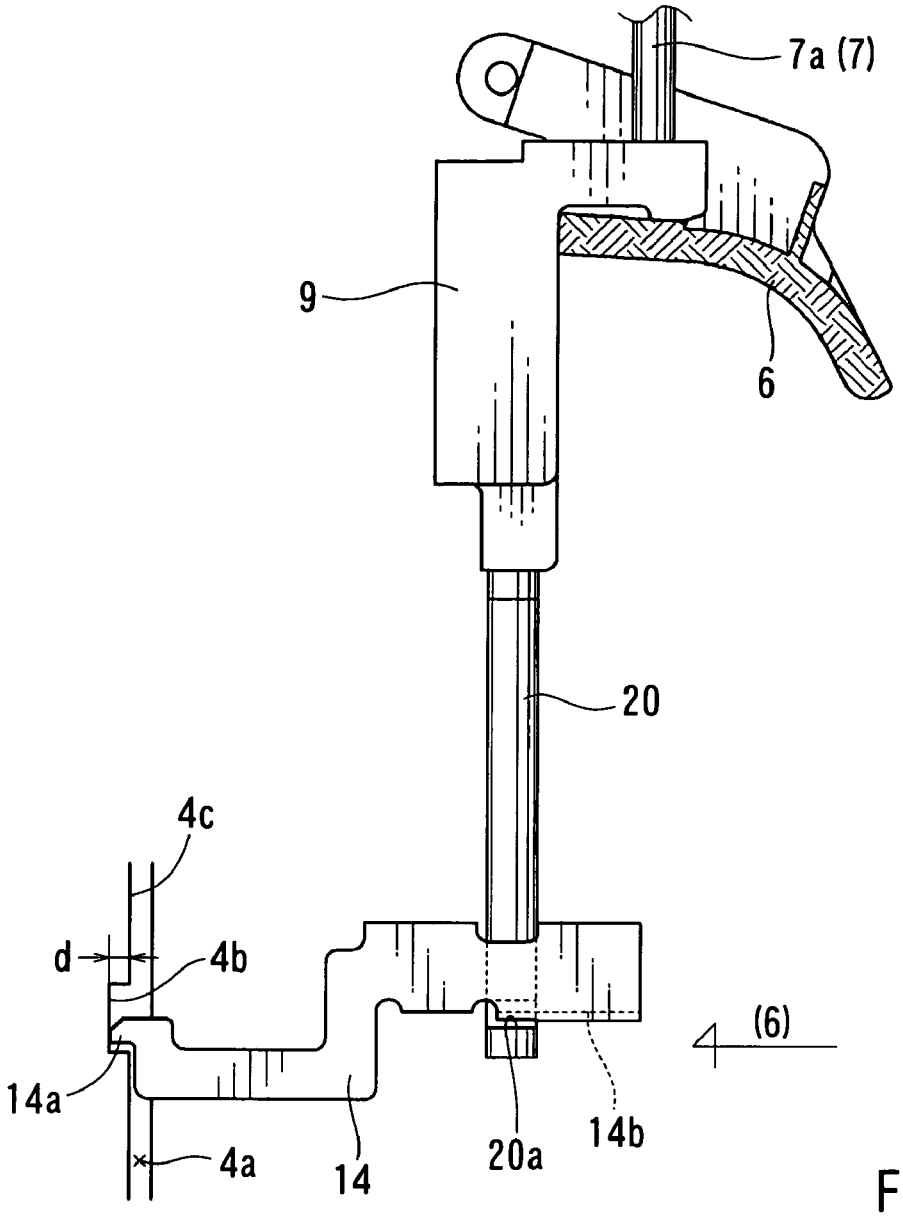
FIG. 5 is an enlarged view showing the positional relationship between a stopper member and a restriction plate of the first representative nailer.
Figure 6:
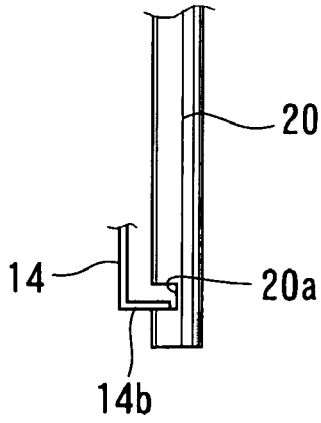
FIG. 6 is a view in a direction of the arrow (6) shown in FIG. 5, detailing the engagement between a stopper edge of the restriction plate and an engaging recess of the stopper member.

The idle driving prevention device will now be described. As shown in FIG. 5, a lower portion of the rear end of restriction plate 14 (the right end as viewed in FIG. 5), having a predetermined width, is bent toward the backside of the magazine body 11 (perpendicularly into the plane formed by FIG. 5) so as to form a stopper edge 14*b*. Conversely, an engaging recess 20*a* is formed in the lower end of the stopper member 20 in order to engage the stopper edge 14*b* (as shown in FIG. 6). The engaging recess 20*a* has a length defined along the axial direction of the stopper member 20 and has a depth in a direction perpendicular to the longitudinal axis of the stopper member 20.

The relative position of the stopper edge 14*b* to the engaging recess 20*a* of the stopper member 20 along the nail feeding direction may vary in response to the number of the nails n remaining within the magazine 10.

More specifically, when at least one nail n remains within the magazine 10 as shown in FIGS. 2 and 3, the stopper edge 14*b* is positioned rearward (to the right as viewed in FIGS. 2 and 3) of the engaging recess 20*a* of the stopper member 20. Therefore, the stopper edge 14*b* does not engage the engaging recess 20*a*.

On the other hand, when the last nail ne has been driven and no nail n exists within the nail driving channel 4*a*, the restriction plate 14 moves further toward the nail feeding direction by the biasing device so that the front end contact portion 14*a* of the restriction plate 14 enters the detection recess 4*b*. Simultaneously, the stopper edge 14*b* engages the engaging recess 20*a* of the stopper member 20, so that the stopper member 20 is prevented from moving upward by the restriction plate 14.

When the stopper member 20 is prevented from moving upward, the restriction block 9 is also prevented from moving upward. Consequently, trigger 6 is prevented from being actuated or pulled by the operator. As a result, the driving operation of the nails n may be restricted. This means that the idle driving operation of the nails can be inhibited when no more nails exist within the nail driving channel 4*a*.

In addition, after the last nail ne has been driven out, the restriction plate 14 moves by a relatively large distance, i.e., the distance corresponding to the depth d of the detection recess 4*b* in addition to the distance corresponding to the thickness of the nail n. This difference in distance allows the stopper edge 14*b* to be reliably positioned so as to not engage the engaging recess 20*a* when the last nail ne remains within the nail driving channel 4*a*, while also allowing the stopper edge 14*b* to be reliably positioned to engage the engaging recess 20*a* when no additional nails n exist within either the nail driving channel 4*a* or within the magazine 10. Therefore, the restriction plate 14 can reliably inhibit the idle driving. operation from inadvertently attempting to drive without a nail in the nail driving channel 4*a*.

As described above, according to the first representative nailer 1, the restriction plate 14 performs the idle driving operation prevention function. The restriction plate 14 is preferably a separate component from the pusher plate 13. In this instance, the restriction plate 14 is disposed below the pusher plate 13. This arrangement enables the detection recess 4*b* to be positioned so as to oppose the lateral side of the lower portions of various nails n, but not to oppose the lateral side of the heads of the various nails n. In addition, the nail driving channel 4*a* permits a shifting movement of the restriction plate 14 by a distance that is larger than the distance corresponding to the thickness of a nail n, after the last nail ne has been driven out.

Therefore, the nails n can be reliably held against the inner wall 4*c* of the nail driving channel 4*a* with the heads, or portions adjacent to the heads, of the nails n reliably supported by the inner wall 4*c* without an increased likelihood of being accidentally bent. This allows a driver 8 to reliably drive the nail n.

Thus, in the known technique, in order to reliably feed various kinds of nails having different lengths, a front end of a pusher is designed to contact the nail heads or portions adjacent to the heads of nails. The known technique requires a detection recess in a nail driving channel to be positioned so as to laterally oppose the heads or the portions adjacent the heads of the nails. The positioning of the detection recess in the known arrangement may cause the heads or the portions adjacent the heads of the nails to be inadvertently bent.

The above representative embodiment of the current invention may be modified in various ways. For example, although in the first representative embodiment the stopper edge 14*b* is formed on the restriction plate 14 and the engaging recess 20*a* is formed in the stopper member 20 in order to engage the stopper edge 14*b*, a projection (not shown) may be formed on the stopper member 20 and an engaging recess (not shown) may be formed in the restriction plate 14 in order to engage the projection. In addition, any other form of engaging mechanisms may be incorporated as long as they cooperate so as to restrict the stopper member 20 by the movement of restriction plate 14 at the time when the last nail ne has been driven out from the nail driving channel 4*a*.

Additionally, in the first representative embodiment in order to reduce the possibility of the heads of the nails being accidentally bent, the detection recess 4*b* is positioned so as to laterally oppose the lower portion of the nail n below the head, when the nails having the shortest available length have been set into the magazine 10. As an alternative or in addition to this arrangement, a detection recess may be positioned on the upper side of the head of a nail n having the longest available length, the position determined when the lower end of such a nail n has first contacted a workpiece during the driving operation (see FIG. 9).

Figure 9:
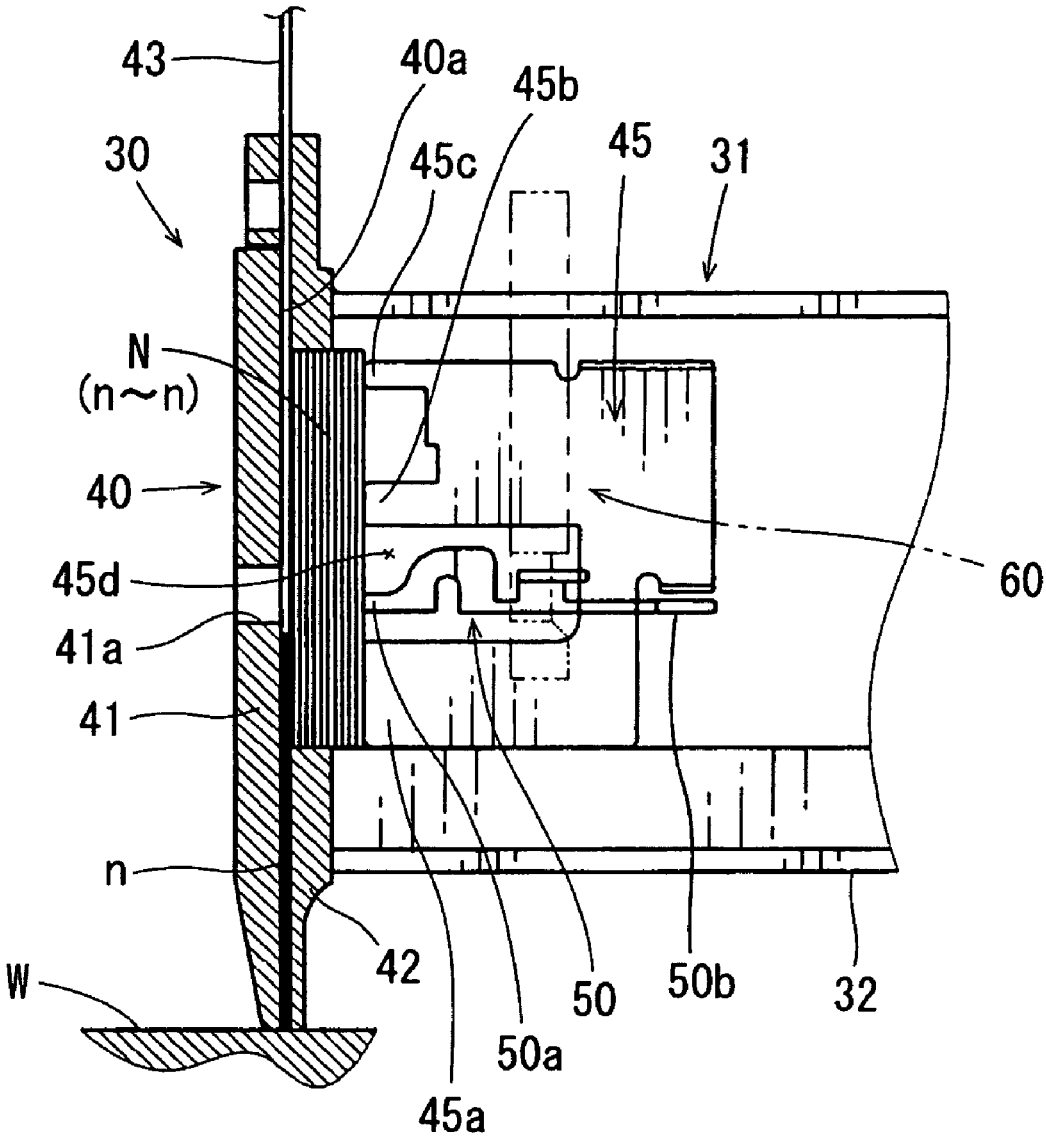
FIG. 9 is a view similar to FIG. 2 but showing an enlarged side view around the connecting region between a driver guide and a magazine of the second representative nailer, and also showing a state where the nails of the longest available length are set with some nails remaining within the magazine and where the nail within the nail driving channel is filled in black for purposes of illustration and has also been driven so as to contact a workpiece.

FIG. 9 shows a second representative nailer 30 having such an alternative or additional detection recess described above, to which reference numeral 41*a* is labeled. The construction of the second representative nailer 30, other than the features primarily shown in FIG. 9, is substantially the same as the first representative nailer 30 and an explanation of similar features may not be repeated.

Referring to FIG. 9, there is shown an idle driving prevention device of the second representative nailer 30. Similar to the first representative nailer 1, the second representative nailer 30 includes a magazine 31 that has a magazine body 32 and a slidable lid (not shown) in order to access the interior of the magazine body 32. A driver guide 40 is attached to one end (left end as viewed in FIG. 9) of the magazine body 32 on the side of the nail feeding direction. The driver guide 40 includes a first plate 41 and a second plate 42 that are lapped with each other and are fixed together by means of fixing bolts (not shown). A nail driving channel 40*a* is defined between the first and second plates 41 and 42 and is adapted to receive one nail n at a time. The nail driving channel 40*a* also is adapted to receive a driver 43 that drives the nails n out of the nail driving channel 40*a* and into the workpiece. The second plate 42 is fixedly mounted to the left end of the magazine body 32. The first plate 41 can be detached from the second plate 42 by releasing the fixing bolts, allowing for easy removal of a nail n in the event that a nail n has become jammed within the nail driving channel 40*a*.

The detection recess 41*a* is formed in the first plate 41 and is different from the detection recess 4*b* of the first representative embodiment. In the second embodiment, the detection recess 41*a* is configured to extend throughout the thickness of the first plate 41. Alternatively, the detection recess 41*a* may be configured as a bottomed recess similar to the configuration of the detection recess 4*b*.

As described previously and shown in FIG. 9, the detection recess 41*a* of the second representative nailer 30 is positioned on the upper side of the head of the nail n having the longest available length, at the time when the lower end of such a nail n has first contacted a workpiece W during the driving operation. In FIG. 9, the nail n that has contacted the workpiece W is filled in with black.

At the time when the lower end of the nail n initially contacts the workpiece W, a large resistance is applied by the workpiece w to the nail n against the driving force. With this arrangement of the detection recess 41*a*, the head of the nail n can be reliably held against the inner wall of the nail driving channel 40*a* (i.e., the inner wall of the fist plate 41), instead of against the opening of the detection recess 41*a*. Therefore, the nail n may be prevented from being accidentally bent, allowing the nail driving operation to be reliably performed.

The position of the detection recess 41*a* may be chosen in at least two different areas; (1) positioned on the upper side of the head of a nail n having the longest available length, the position determined at the time when the lower end of such a nail n has first contacted a workpiece W during the driving operation as described above; and (2) positioned to be lower than the head of a nail n having the shortest available length and set into the magazine 10, the position determined before the driving operation (this position is similar to the one chosen for the detection recess 4*b* of the first representative embodiment). With the arrangements taught by this invention, at two significant times, when the driver initially contacts the head of the nail and when the lower end of the nail first contacts the workpiece, the head of the nail n can be reliably held against the inner wall of the nail driving channel. Therefore, the heads of the nails can be prevented from being inadvertently bent during the driving operation and subsequent inappropriate driving conditions (e.g. jamming, etc.) of the nail n can be avoided.

Similar in function to the detection recess 4*b* of the first representative nailer 1, the detection recess 41*a* is adapted to receive a front end contact portion 50*a* of a restriction plate 50. The restriction plate 50 is configured to be functionally similar to the restriction plate 14 of the first representative nailer 1, but the restriction plate 50 is positioned at a different level (relative to a plane containing the lower ends of the nails n and perpendicular to the nail driving direction) than the restriction plate 14. In this connection, a slot 45*d* is formed in a pusher plate 45 of the second representative nailer 30, so that the restriction plate 50 is disposed within the slot 45*d*. The front end (left end as viewed in FIG. 9) of the pusher plate 45 includes a lower contact portion 45*a*, a middle contact portion 45*b*, and an upper contact portion 45*c*, for contacting with the strip nails N. The slot 45*d* in this embodiment is preferably positioned between the lower contact portion 45*a* and the middle contact portion 45*b*.

Also, similar to the restriction plate 14 of the first representative nailer 1, the restriction plate 50 of the second representative nailer 30 is configured as a separate component member apart from pusher plate 45. In addition, the restriction plate 50 and the pusher plate 45 are biased toward the nail feeding direction by their respective biasing devices (not shown). Thus, in essentially the same manner as the first representative embodiment, when the last nail ne has been driven out from the nail driving channel 40*a* by the driver 43 such that no nail n exists within the nail driving channel 40*a*, the pusher plate 45 moves by a distance corresponding to the thickness of one nail by the biasing force of the corresponding biasing device. The contact portions 45*a*, 45*b*, and 45*c*, of the pusher plate 45 consequently contact the inner wall of the first plate 41. On the other hand, the restriction plate 50 is able to move due to the biasing force applied to the restriction plate 50, by a distance that is larger than the distance corresponding to the thickness of an individual nail because the front end contact portion 50*a* of the restriction plate 50 enters into the detection recess 41*a*. At substantially the same time, a stopper edge 50*b* of the restriction plate 50 engages an engaging recess 60*a* formed in a stopper member 60. Stopper member 60 corresponds to the stopper member 20 of the first representative embodiment. As a result, the trigger 6 may be prevented from being actuated or pulled by the operator, so that the idle driving operation of the nails can be inhibited in a similar manner to the first representative embodiment.

The stopper member 60 of the second representative embodiment has been improved to solve the following potential problems that may occur when thin nails, e.g., those having a thickness of 0.6 mm, are driven out in combination with using stopper member 20.

Figure 10:
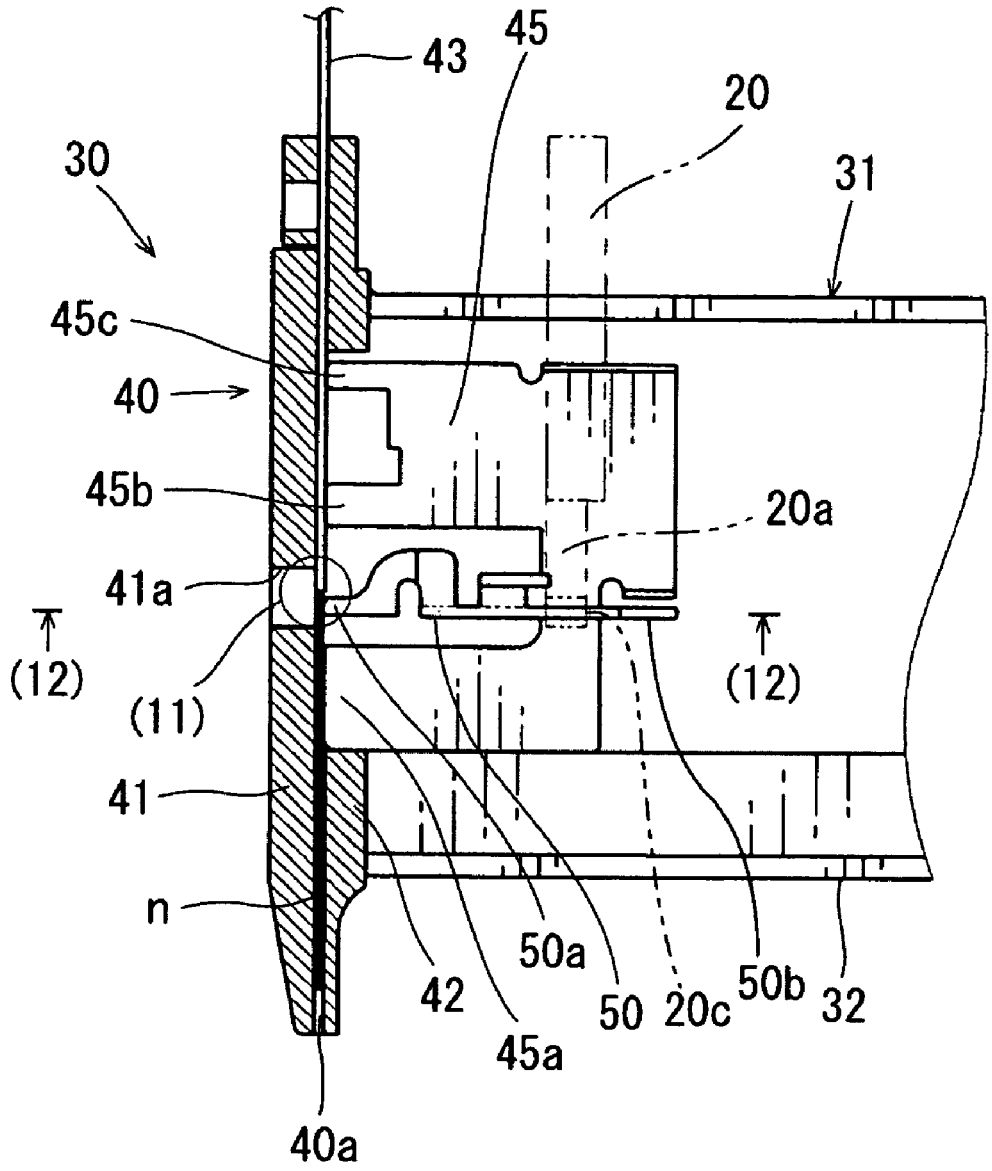
FIG. 10 is a view similar to FIG. 9 but showing a state during which a driver is driving out the last nail.
Figure 11:
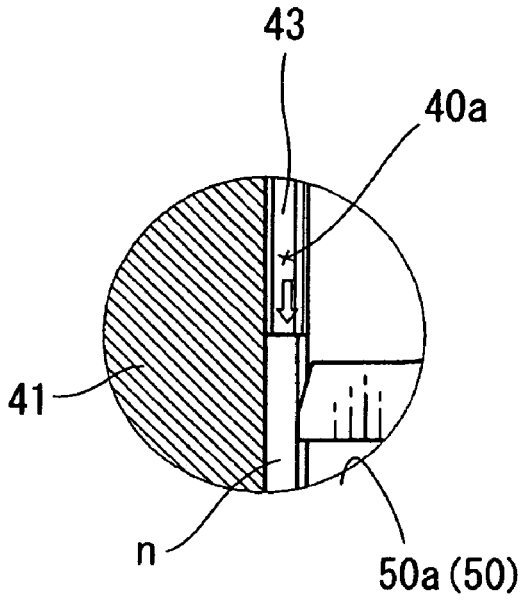
FIG. 11 is an enlarged view of the portion indicated by a circle (11) in FIG. 10.

The driver 43 must have a sufficient thickness or width in order to ensure that the driver 43 has necessary strength for repeated operation. The minimum diameter of the nail driving channel 40*a* must be determined in order to accommodate the thickness or width of the driver 43. Therefore, in situation where the driver 43 is driving thin nails n, the tip of the front end contact portion 50*a* of the restriction plate 50 may slightly protrude into the nail driving channel 40*a* when the last nail ne has been fed into the nail driving channel 40*a* (as shown in FIGS. 10 and 11).

Figure 12:
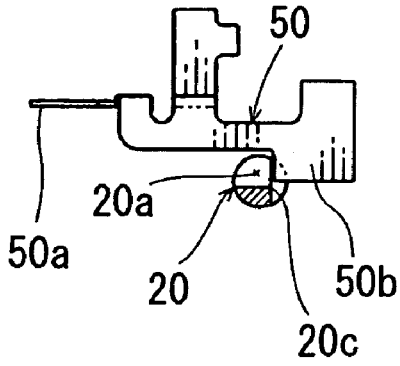
FIG. 12 is a view in a direction indicated by the arrows (12) in FIG. 10 and showing the positional relationship between a restriction plate and a stopper member.

In addition, when the last nail ne has been supplied into the nail driving channel 40*a* but has not yet been driven by the driver 43, the stopper edge 50*a* of the restriction plate 50 does not engage the engaging recess 20*a* of the stopper member 20. The stopper edge 50*a* is spaced by a small distance from a side surface 20*c* of the stopper member 20 as schematically shown in FIG. 12.

When the trigger 6 has been pulled to drive out the last nail ne by the driver 43 in this state, the driver 43 also impact the front end contact portion 50*a* of the restriction plate 50. Consequently, it is likely that the front end contact portion 50*a* will be worn or damaged by this and subsequent impacts. As a result, the ability and accuracy of the detection of an idle driving condition by the idle driving prevention device may be significantly degraded.

Figure 13:
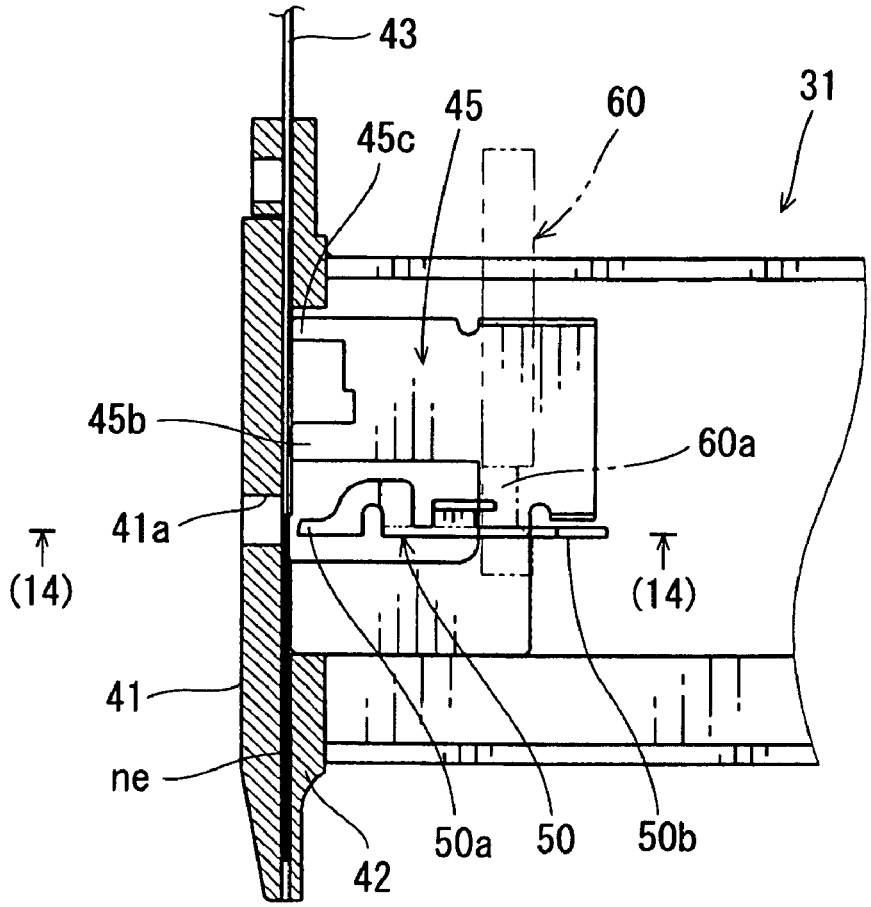
FIG. 13 is a view similar to FIG. 10 but showing a state where the last nail is being driven out by a driver but the nail does not yet contact the workpiece and where the restriction plate has been retracted by a slight distance and the front end of the restriction plate has been moved away from the nail driving channel due to sliding contact between a stopper edge of the restriction plate and an inclined surface of the stopper member.
Figure 14:
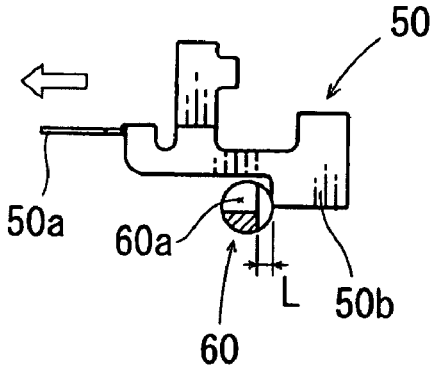
FIG. 14 is a view in a direction indicated by the arrows (14) in FIG. 13 and showing the positional relationship between the restriction plate and the stopper member.

The stopper member 60 of the second representative embodiment has been improved to address these problems. The relationship between the restriction plate 50 and the stopper member 60 during the driving operation of the last nail ne are shown in FIGS. 13 and 14. As shown in these figures, the stopper edge 50*b* has a desired width and extends from the rear end of the restriction plate 50 towards the stopper member 60. In FIG. 14, the outline arrow indicates the nail feeding direction and the restriction plate 50 is biased in this direction by the biasing device.

Figure 15:
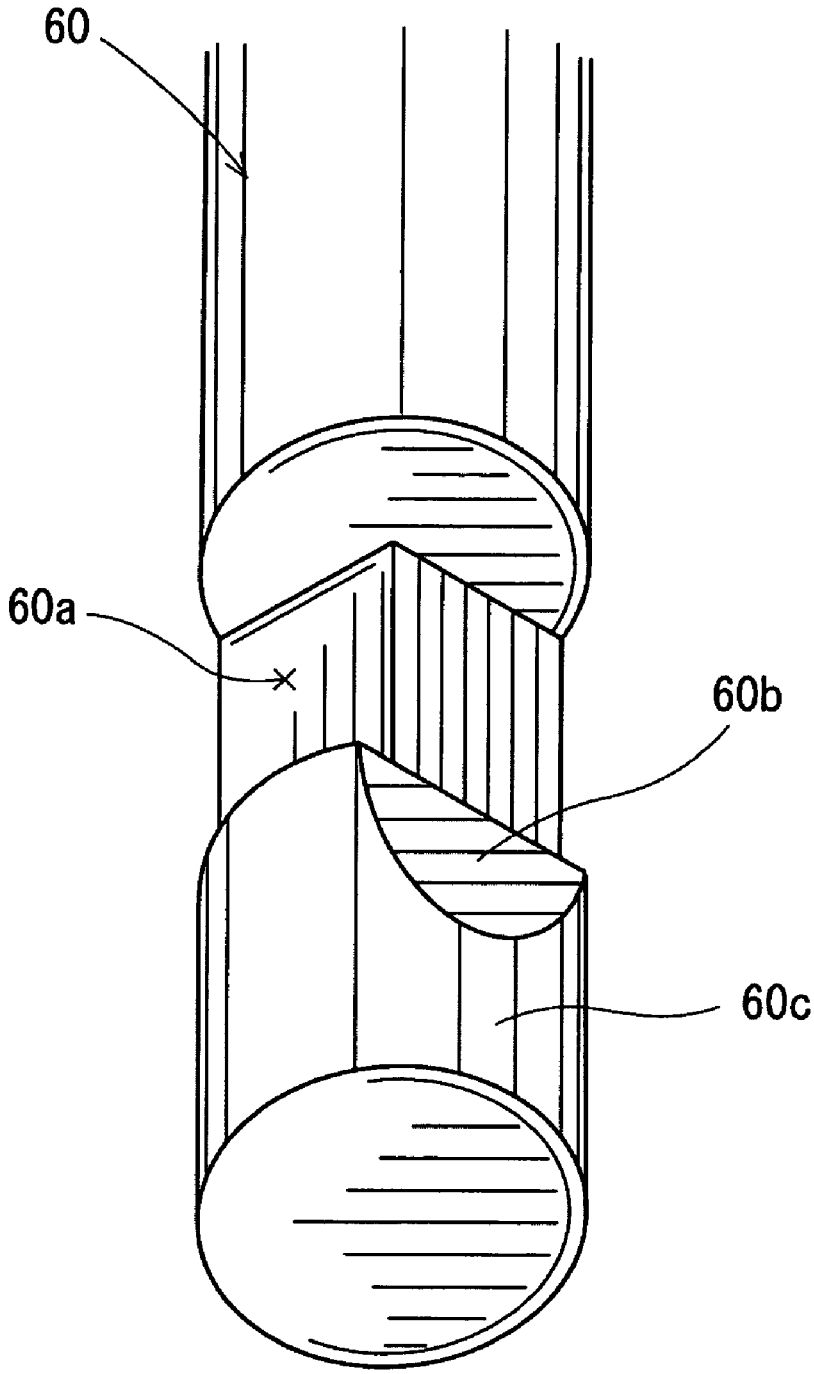
FIG. 15 is an enlarged perspective view of a lower portion of the stopper member of the second representative nailer.
Figure 16:
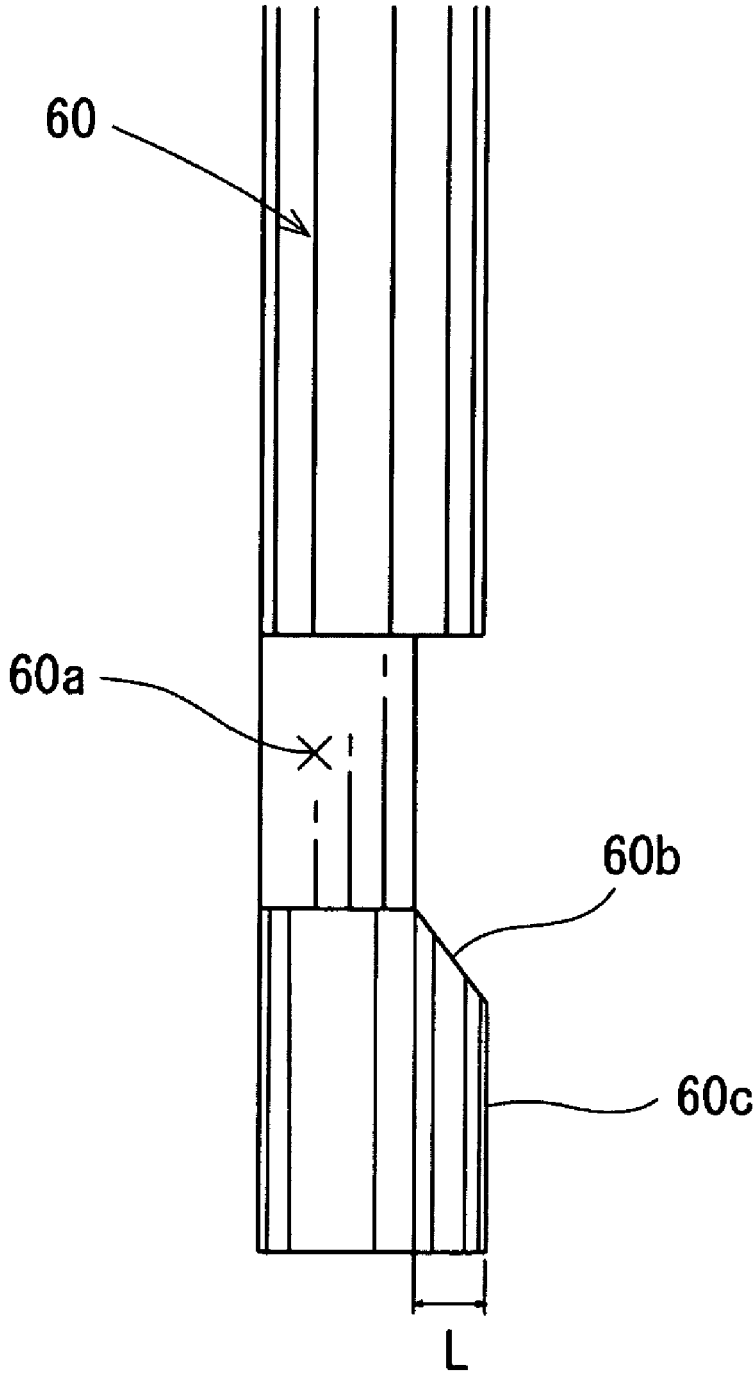
FIG. 16 is an enlarged side view of the lower portion of the stopper member of the second representative nailer.

In the same manner as the stopper member 20 of the first representative embodiment, the stopper member 60 is attached to the lower end of the restriction block 9 and extends downwardly from the restriction block 9 (see FIG. 5). However, the stopper member 60 is different from the stopper member 20 in that the stopper member 60 has an inclined surface 60*b*, in addition to an engaging recess 60*a* (see FIGS. 15 and 16) that corresponds to the engaging recess 20*a* of the stopper member 20. The inclined surface 60*b* is disposed on a side opposing the nail feeding direction and is formed in continuity with the engaging recess 60*a*. Therefore, the thickness of the stopper member 60 is greater than the thickness of the stopper member 20 by a distance L in a direction opposite to the nail feeding direction. In other words, a side surface 60*c* of the stopper member 60 is offset relative to the side surface 20*c* of the stopper member 20 by the distance L. Here, the position of engaging recess 60*a* in the nail feeding direction is set to coincide with the position of the engaging recess 20*a* of the first representative embodiment. The positional relationship between the stopper member 60 and the stopper edge 50*b* during the nail driving operation caused by the operation of the trigger 6 will now be described with reference to FIGS. 17(A), 17(B), 17(C), 17(D) and 17(E). FIGS. 17(A) to 17(D) show a sequence of events where stopper member 60 is going through one cycle (the driving out of nail ne) and the restriction plate 50 is moving leftward in the feeding direction.

Figures 17A, 17B, 17C, 17D, 17E:
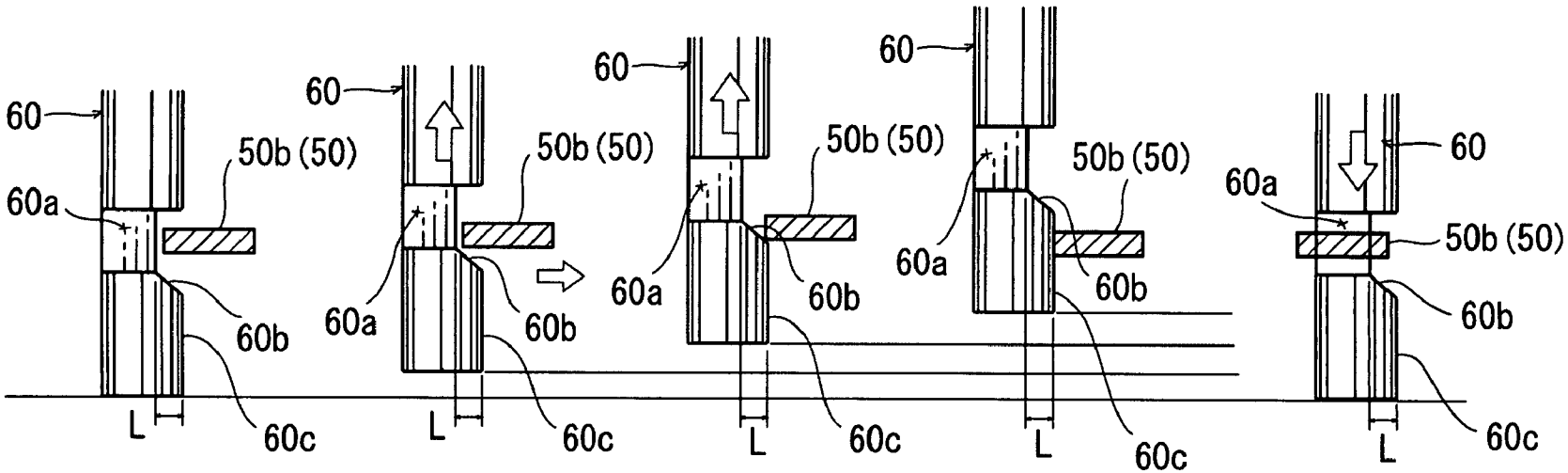
FIG. 17(A) is a schematic view showing the positional relationship between the stopper edge of the restriction plate and the lower portion of the stopper member when the trigger has not yet been pulled to actuate the driver.
FIG. 17(B) is a schematic view similar to FIG. 17(A) but showing the positional relationship when the stopper edge has contacted an inclined surface of the stopper member at the beginning of the pulling of the trigger.
FIG. 17(C) is a schematic view showing the positional relationship when the stopper member has moved upward to retract the restriction plate as the trigger is further pulled beyond the state shown in FIG. 17(B)
FIG. 17(D) is a schematic view showing the positional relationship when the stopper member has been moved to the end of its upper stroke end and the stopper edge has contacted the side surface of the stopper member to inhibit the movement of the restriction plate in the nail feeding direction at the completion of the pulling operation of the trigger.
FIG. 17(E) is a schematic view showing the positional relationship when the trigger has returned to its initial OFF position, allowing the stopper member to move to the initial position of the stopper and causing the stopper edge of the restriction plate to engage with an engaging recess of the stopper member in order to inhibit idle driving operation after the driving out of the last nail has been completed.

As described previously, when the last nail ne has been supplied into the nail driving channel 40*a*, the front end contact portion 50*a* of the restriction plate 50 may enter into the nail driving channel 40*a* by a small distance (see FIGS. 10 and 11) if the nails used are thin. FIG. 17(A) shows the relationship between the stopper member 60 and the stopper edge 50*b* at the point in time when the last nail ne is in the nail driving chamber. In FIG. 17(A), the front part (left part as viewed in FIG. 17(A)) of the stopper edge 50*b* is positioned immediately before the engaging recess 60*a* of the stopper member 60.

As the trigger 6 is pulled in order to drive out the last nail ne, the restriction plate 9 and the stopper member 60 may move upward as viewed in FIGS. 17(A) to 17(D).

As the stopper 60 moves upward as shown in FIG. 17(B), the front part of the stopper edge 50*b* may contact the inclined surface 60*b* of the stopper member 60. As the trigger 6 is continued to be pulled to further move the stopper member 60 upward, the restriction plate 50 moves rightward, in the direction opposite to the nail feeding direction, through the cooperation between the stopper edge 50*b* and the inclined surface 60*b* that slidably contact one another. Due to this rightward movement of the restriction plate 50, the front end contact portion 50*a* of the restriction plate 50 may retract from the nail driving channel 40*a*. As the trigger 6 is further pulled, the trigger valve 7 is actuated (opened) to move the driver 43 downward after the front end contact portion 50*a* of the restriction plate 50 retracts from the nail driving channel 40*a*. As a result, the last nail ne is driven out from the nail driving channel 40*a* without the driver 43 contacting the front end contact portion 50*a*. At this point in the cycle, the restriction plate 50 is maintained in this withdrawn position, i.e., the front end contact portion 50*a* is outside of the nail driving channel 40*a*, because the stopper edge 50*b* of the restriction plate 50 is in contact with the side surface 60*c* of the stopper member 60 (as shown in FIG. 17(D)). Therefore, the impact of the driver 43 is not on the front end contact portion 50*a* of the restriction plate 50, but instead the full impact of the driver 43 is only on the last nail ne.

When the pulling operation of the trigger 6 is released after the driver 43 has reached its stroke end and the last nail ne has been driven out into the workpiece W, the trigger 6 may be urged to return to the initial position (OFF position) by a force of a spring that biases the valve stem 7*a*. Therefore, the stopper member 60 may move downward to its initial position (see FIG. 17(E)). FIG. 17(E) describes the situation where the stopper member 60 has returned to the initial position, no nail, ne or otherwise, exists within the nail driving channel 40*a* (i.e., the nail driving channel 40*a* is empty), and the driver 43 also has returned to its initial position (upper stroke end). Therefore, by the biasing force of the corresponding biasing device, the restriction plate 50 may move in the nail feeding direction by a distance that is greater than a distance corresponding to the thickness of one nail ne, so that the front end contact portion 50*a* enters the detection recess 41*a*. As a result, the stopper edge 50*b* of the restriction plate 50 may engage the engaging recess 60*a* of the stopper member 60 as shown in FIG. 17(E). Due to this engagement, possible the idle driving operation of the nail gun can be prevented. Thus, because the stopper member 60 is prevented from moving upward by the restriction plate 50, it is not possible to pull the trigger 6 to the extent necessary to drive the driver 43 when no nail n is supplied into the nail driving channel 40*a*. If the driver 43 is driven when no nail is supplied within the nail driving channel 40*a*, there exists a possibility of the lower end of the driver 43 directly contacting the workpiece W. Therefore, this embodiment reduces the chances that the driver 43 may damage the workpiece W.

In the situation that a nail strip N consisting of thin nails n, e.g. those having a thickness of approximately 0.6 mm and otherwise known as "pin nails," is set into the magazine 31, the front end contact portion 50*a* of the restriction plate 50, i.e., the idle driving prevention device, may enter into the nail driving channel 40*a* by a small distance at the time when the last nail ne has been fed into the nail driving channel 40*a*. According to the second representative embodiment, the front end contact portion 50*a* of the restriction plate 50 may avoid a substantial impact from the driver 43 during the process of driving out the last nail ne because the restriction plate 50 is forcibly retracted such that the front end contact portion 50*a* of the restriction plate 50 is moved away from the nail driving channel 40*a*. The retraction is due to an interface between the inclined surface 60*b* of the stopper member 60 and the stopper edge 50*b* of the restriction plate 50. Therefore, the front end contact portion 50*a* of the restriction plate 50 may avoid substantial damaged by the driver 43 and the accuracy of the detection of the idle state by the idle driving prevention device can be properly maintained during a long lifetime of use of the nail gun.

In addition, in some situations the trigger 6 may be immediately pulled after the last nail ne has been driven out from the nail driving channel 40*a*, possibly as a result of a long period of rapidly repeating driving operations. In such a situation, the stopper edge 50*b* of the restriction plate 50 may not be able to successfully enter the engaging recess 60*a* of the stopper member 60, but instead, may only abut the side surface 60*c* of the stopper member 60 (such as in the state shown in FIG. 17(D)). This may occur due to a mismatch in the timing of the pulling operation, i.e., the timing of the upward movement of the stopper member 60, and the range of movement of the trigger switch 6. However, even for this type of situation, the front end contact portion

50*a* of the restriction plate 50 may be maintained outside of the nail driving channel 40*a*. The position of the restriction plate 50 is due to the side surface 60*c* being positioned forwardly of the engaging recess 60*a* by a distance L, approximately equal to the width of a nail in the nail feeding direction of the inclined surface 60*a*. In other words, the thickness of the stopper member 60 at the side surface 60*c* is greater than the thickness of the stopper member 20 by an amount equal to the distance L. Therefore, the front end contact portion 50*a* of the restriction plate 50 may still avoid accidentally receiving an impact from the driver 43.

As an alternative to the inclined surface 60*b* formed on the stopper member 60 in the second representative embodiment, an inclined surface similar to the inclined surface 60*b* may be formed on the stopper edge 50*b* of the restriction plate 50. Thus, such an inclined surface may be formed on a surface in the nail feeding direction of the stopper edge 50*b* so that the inclined surface can slidably contact the stopper member 60 in a position adjacent to the lower end of the engaging recess 60*a*. Substantially the same operation and effect as attributed to the inclined surface 60*b* can also be attained by this arrangement.

Although the above first and second representative embodiments have been described in connection with nailers for finishing purposes in which the flat nail strip N consisting of a plurality of parallel nails n joined to each other is stored within the magazine, the present invention also may be applied to other types of nailers and fastener driving devices, for example such as those for driving tacks and staplers.

In addition, although the first and second representative embodiments have the magazine storing the flat nail strip N shown as being substantially perpendicular to the nail driving direction, the magazine storing the strip of fasteners can be at an angle to the fastener driving direction and remain within the scope of the invention.

What is claimed is:

1. A fastener driving tool comprising:

a tool body:

a driver guide coupled to the tool body and defining a fastener driving channel;

a magazine coupled to the driver guide and arranged and constructed to store plural types of fasteners that vary with respect to a length of a corresponding fastener, wherein the plural types of fasteners are stored such that ends of the fasteners, opposite to the heads of the fasteners, are positioned within the magazine at the same reference level irrespective of differences in type, wherein only one type of the plural types of fasteners is stored within the magazine during a single driving operation;

a pusher plate arranged and constructed to individually feed each of the corresponding fasteners of the plural types of fasteners into the fastener driving channel;

a driver arranged and constructed to drive out each corresponding fastener fed into the fastener driving channel;

a trigger operable by an operator in order to actuate the driver;

an idle driving prevention device arranged and constructed to prevent the driving operation when no corresponding fastener exists within the fastener driving channel, the idle driving prevention device comprising:

a stopper member coupled to the trigger and movable in response to the operation of the trigger; and a detection recess defined in an inner wall of the fastener driving channel in a position not opposing a head of the corresponding fastener that has been fed into the fastener driving channel, wherein the head of the corresponding fastener is driven via contact with the driver, wherein a restriction plate is disposed within the magazine and comprises an end portion, wherein the restriction plate is biased in a fastener feeding direction, wherein the restriction plate moves together with the pusher plate in the fastener feeding direction during the feeding of the corresponding fasteners, wherein the end portion of the restriction plate enters the detection recess when no corresponding fastener is positioned within the fastener driving channel, wherein when the end portion of the restriction plate is in the detection recess, the restriction plate engages the stopper member, inhibiting the further operation of the trigger;

wherein the detection recess is disposed at a position, spaced in a direction opposite to the fastener driving direction, away from the head of the corresponding fastener having a longest available length accommodated by the magazine, when an end of the corresponding fastener fed into the fastener driving channel contacts a workpiece during the driving operation of the corresponding fastener through the fastener driving channel, wherein the end of the corresponding fastener is opposite to the head of the corresponding fastener.

2. A fastener driving tool as in claim 1, wherein the detection recess is disposed at a position, spaced in the fastener driving direction, away from the head of the corresponding fastener that has a shortest available length accommodated by the fastener driving channel.

3. A fastener driving tool as in claim 1, wherein the stopper member further includes an engaging recess and the restriction plate further includes a stopper edge, wherein the movement of the stopper member in response to the operation of the trigger is restricted when the stopper edge engages the engaging recess, and wherein an inclined surface with respect to the moving direction of the stopper member is formed on one of a portion of the stopper member adjacent to the engaging recess or the stopper edge of the restriction plate, so that the restriction plate is shifted in a direction away from the fastener driving channel through sliding contact between the inclined surface and the one of the portion of the stopper member or the stopper edge, as the stopper member moves in response to the operation of the trigger at least during the driving operation of a last corresponding fastener fed into the fastener driving channel.

4. A fastener driving tool comprising:

a tool body;

a driver guide coupled to the tool body and defining a fastener driving channel;

a magazine coupled to the driver guide and arranged and constructed to store plural kinds of fasteners that vary with respect to length, wherein only a single kind of the plural kinds of available fasteners is stored within the magazine during a driving operation; and a detecting device arranged and constructed to detect when no fastener exists within the fastener driving channel, wherein the detecting device includes a detection member and a detection recess formed in the fastener driving channel, the detection member having a front end contact portion, wherein the front end contact portion is in contact with at least one fastener stored within the magazine, so that the front end of the detection member engages the detection recess when no fastener exists within the magazine and the fastener driving channel, wherein the detection member is movable by a distance greater than a thickness of the fastener when a last fastener has been driven out from the fastener driving channel, wherein the detection recess is positioned so as to not oppose to a head of the fastener that has been fed into the fastener driving channel, wherein the detection recess is disposed at a position, spaced in a direction opposite to the fastener driving direction, away from the head of the fastener having a longest available length accommodated by the magazine, wherein the detection recess position is determined at a point in time when an end of the fastener contacts a workpiece during the driving operation of the fastener through the fastener driving channel, wherein the end of the fastener is opposite to the head of the fastener.

5. A fastener driving tool as in claim 4, wherein the detection recess includes a first detection recess and a second detection recess, and wherein the first detection recess is disposed at a position, spaced in the fastener driving direction, away from the head of the fastener that has a shortest available length accommodated by the magazine, and wherein the second detection recess, spaced in a direction opposite to the fastener driving direction, away from the head of the fastener having the longest available length accommodated by the magazine, wherein the second detection recess position is determined at a point in time when the end of the fastener contacts the workpiece during the driving operation of the fastener through the fastener driving channel.

6. A fastener driving tool as in claim 4, further including a trigger operable by an operator in order to drive out the fastener fed into the fastener driving channel, and an engaging member coupled to the trigger so that the engaging member moves together with the trigger as the trigger is operated, and wherein the detection member is engageable with the engaging member to prevent the trigger from being operated when the front end of the detection member enters the detection recess.

7. A fastener driving tool as in claim 6, further including a driver that is movable within the fastener driving channel in order to apply an impact to the head of the fastener fed into the fastener driving channel when the trigger is operated.

8. A fastener driving tool as in claim 7, wherein the engaging member includes an engaging recess and the detection member includes an engaging edge engageable with the engaging recess, and wherein the engaging member has an inclined surface inclined with respect to the moving direction of the engaging member and formed at an entrance of the engaging recess, wherein the detection member is shifted in a direction away from the fastener driving channel through sliding contact between the inclined surface of the engaging recess and the engaging edge, wherein the detection member is shifted at least as the engaging member moves in response to the operation of the trigger, wherein the operation of the trigger is performed in order to drive out a last fastener fed into the fastener driving channel.

9. A fastener driving tool comprising:

a tool body;

a driver guide coupled to the tool body and defining a fastener driving channel;

a magazine coupled to the driver guide and arranged and constructed to store plural kinds of fasteners that vary with respect to length, wherein only a single kind of the plural kinds of available fasteners is stored within the magazine during a driving operation;

a detecting device arranged and constructed to detect when no fastener exists within the fastener driving channel, wherein the detecting device includes a detection member and a detection recess formed in the fastener driving channel, the detection member having a front end contact portion, wherein the front end contact portion is in contact with at least one fastener stored within the magazine, so that the front end of the detection member engages the detection recess when no fastener exists within the magazine and the fastener driving channel, wherein the detection member is movable by a distance greater than a thickness of the fastener when a last fastener has been driven out from the fastener driving channel, wherein the detection recess is positioned so as to not oppose to a head of the fastener that has been fed into the fastener driving channel; and a pusher plate biased in the fastener feeding direction toward the fastener driving channel and having a front end that contacts a last fastener included in a fastener strip when the last fastener is within the magazine and when the last fastener is within the fastener driving channel, so as to urge the fastener strip toward the fastener driving channel, wherein the pusher plate is a separate component from the detection member.

10. A fastener driving tool comprising:

a tool body;

a driver guide coupled to the tool body and defining a fastener driving channel;

a magazine coupled to the driver guide and arranged and constructed to store at least one type of fastener, wherein the type of fastener can vary with respect to length;

a detecting device arranged and constructed to detect when no corresponding fastener exists within the fastener driving channel, wherein the detecting device includes a detection member biased in a fastener feeding direction and contacting a last one of the at least one type of fastener within the magazine;

a driver movable within the fastener driving channel in order to apply an impact to a head of the corresponding fastener, fed into the fastener driving channel, when the trigger is operated;

an impact prevention device arranged and constructed to prevent application of the impact to the detecting member by the driver after the last corresponding fastener is driven out from the fastener driving channel by the driver;

a trigger operable by an operator in order to drive out the corresponding fastener fed into the fastener driving channel; and an engaging member coupled to the trigger so that the engaging member moves together with the trigger as the trigger is operated, wherein the detection member is engageable with the engaging member to prevent the trigger from being operated when the detection device detects no corresponding fastener within the fastener driving channel, wherein the impact prevention device comprises a cam mechanism provided between the detection member and the engaging member, so that the detection member is moved away from the fastener driving channel as the engaging member is moved together with the trigger, at least when the trigger is operated to drive out the last corresponding fastener.

11. A fastener driving tool as in claim 10, wherein the engaging member moves substantially perpendicular to the fastener feeding direction and the cam mechanism includes an inclined surface formed on at least one of the engaging member or the detection member and the cam mechanism is inclined with respect to the moving direction of the engaging member.

12. A fastener driving tool as in claim 10 further comprising:

a detection recess within the fastener driving channel;

wherein the detecting member engages the detection recess after the last corresponding fastener is driven out of the fastener driving channel; and wherein the detection recess is positioned so as to not oppose the head of the corresponding fastener fed into the fastener driving channel.

* * * * *